US005560077A

United States Patent [19]

Crotchett

[11] Patent Number: 5,560,077

[45] Date of Patent: Oct. 1, 1996

[54] VACUUM DUSTPAN APPARATUS

[76] Inventor: Diane L. Crotchett, 522 N. West St., Anaheim, Calif. 92801

[21] Appl. No.: 344,870

[22] Filed: Nov. 25, 1994

[51] Int. Cl.[6] ..... A47L 5/00; A47L 9/02

[52] U.S. Cl. ..... 15/339; 15/340.1; 15/DIG. 1; 15/415.1

[58] Field of Search ..... 15/340.1, 347, 15/350, 351, 415.1, 319, 339, DIG. 1

[56] References Cited

U.S. PATENT DOCUMENTS

| | | | |
|---|---|---|---|
| 1,000,383 | 8/1911 | Drake | 15/415.1 |
| 1,047,487 | 12/1912 | Barnes | 15/351 |
| 1,149,227 | 8/1915 | Strode . | |
| 1,336,994 | 4/1920 | Barnes | 15/347 |
| 1,533,368 | 4/1925 | Berg | 15/415.1 |
| 1,785,675 | 12/1930 | Cundiff | 15/415.1 |
| 2,049,603 | 8/1936 | Dietenberger | 15/347 |
| 2,280,751 | 4/1942 | Davis | 15/415.1 |
| 2,450,172 | 9/1948 | Stoner . | |
| 2,519,741 | 8/1950 | Caughey | 15/374 |
| 2,590,734 | 3/1952 | Strong . | |
| 3,186,022 | 6/1965 | Forslund | 15/347 |
| 3,257,681 | 6/1966 | Miller | 15/347 |
| 3,626,535 | 12/1971 | Bond | 15/415.1 |
| 4,062,085 | 12/1977 | Duncan . | |
| 4,105,420 | 8/1978 | Moore . | |
| 4,173,809 | 11/1979 | Ku | 15/319 |
| 4,299,007 | 11/1981 | Hug . | |
| 4,306,329 | 12/1981 | Yokoi . | |
| 4,360,947 | 11/1982 | DeCosa et al. . | |
| 4,369,543 | 1/1983 | Chen et al. . | |
| 4,653,137 | 3/1987 | Fleischhauer | 15/374 |
| 4,833,752 | 5/1989 | Merrick | 15/415.1 |
| 4,854,000 | 8/1989 | Takimoto . | |
| 5,014,388 | 5/1991 | Schiazza | 15/DIG. 1 |
| 5,035,024 | 7/1991 | Stiner et al. . | |
| 5,109,566 | 5/1992 | Kobayashi | 15/319 |

*Primary Examiner*—Frankie L. Stinson
*Assistant Examiner*—Randall E. Chin
*Attorney, Agent, or Firm*—Fulwider Patton Lee & Utecht

[57] ABSTRACT

A vacuum dustpan, including a vacuum unit with interior ducting terminating in marginal nozzles extending along the bottom periphery of a housing, with multidirectional rollers supporting the vacuum unit, and a separate charging nest for charging operations.

5 Claims, 3 Drawing Sheets

3

VACUUM DUSTPAN APPARATUS

BACKGROUND OF THE INVENTION

1. Field of the Invention

The invention relates to vacuum suction devices and more particularly to a cordless vacuum dustpan which automatically gathers and collects dust and debris swept to it.

2. Description of the Prior Art

It has long been the practice in cleaning non-carpeted surfaces by using a broom or a vacuum cleaner. Brooms are typically manipulated to sweep the dirt across the surface of a hard finish or non-carpeted floor to be swept into a shovel-shaped dustpan. This practice has always had the shortcoming of requiring some degree of care and dexterity in the manipulation of the dirt collected, particularly in the collection of light dust particles or animal hairs, which are easily distributed by relatively light air currents, such as those generated by the simple movement of the broom itself. Dustpans have typically been constructed of formed sheet metal or plastic configured with a forwardly opening flat bottom, wide scoop and a rearwardly projecting rigid handle. The manipulation of such device in turn typically requires a considerable degree of bending or stooping on behalf of the operator, an exercise that can be stressful, fatiguing and even painful to those with back problems. Even when such dustpans have been constructed with long handles pivotally carrying the scoop, the operator has still been left with the sometimes challenging task of endeavoring to concurrently manipulate a long handled broom and dustpan assembly in an effort to guide dirt into the scoop to be captured without spillage for balancing thereof in the scoop while being transported to a trash can or compactor. These shortcomings of the broom and conventional dustpan arrangements have led to the design of vacuum cleaners, both of the upright type with a long handle and the horizontal type with long hoses and nozzles. Vacuum cleaning devices which have particular utility for cleaning such floor surfaces of dirt and dust with some degree of ease have certain drawbacks.

Typical vacuum cleaners involve the use of somewhat bulky devices to generate a vacuum and may have an inlet port with a rotary brush and bristles or may incorporate a hose and nozzle to facilitate drawing dirt thereinto from some distance away. Previous considerations of vacuum motor power, overall weight, vacuum suction duct design, and aesthetic appeal necessitated a methodology of "bringing the cleaner to the dirt," or at least close enough to the dirt to be reached by a hose of finite length. This methodology is often tedious and leads to fatigue brought on by over manipulation of the motor and blower housing.

One solution to the fatigue problem involves remote control means. Examples include those shown in U.S. Pat. Nos. 4,306,329; 4,369,543; and 4,854,000. These devices allow a user to guide a vacuum device multidirectionally using a handheld remote control. This reduces activity, such as stooping and bending often causing fatigue. However, remote operation of these devices fails to address the related problem of requiring the user to remove the devices from storage each time they are to be used for transport into close proximity with the dirt to be cleaned.

Another effort addressing fatigue during cleaning involves miniaturizing the cleaning device (U.S. Pat. No. 5,035,024 to Steiner, et al). Although beneficial in that the apparatus is easily manipulated, the lightweight nature of the device precludes installation of a powerful motor for efficient collection of relatively large particles. This necessitates direct device manipulation proximate the area to be cleaned, usually involving bending/stooping. Therefore, the inconvenience of guiding a vacuum cleaning device directly over a surface to be cleaned leaves substantial room for improvement in the prior art vacuum cleaner.

SUMMARY OF THE INVENTION

The vacuum dustpan of the present invention provides suction capability which greatly reduces the amount of physical activity required to pick up dust and dirt. Moreover, additional features minimize stooping and bending, reducing the level of fatigue experienced during cleaning.

The invention includes a wheeled housing which encapsulates a vacuum motor assembly. The housing interior forms vacuum ducting joining a vacuum chamber to nozzles coextensive with the underside of the housing. The nozzles extend peripherally about the underside edge of the housing. Sufficient suction generated by the vacuum motor assembly allows the device to collect dirt swept near it from any direction, thus freeing the user from manipulating the entire apparatus directly over the area to be cleaned. A protruding toggle switch atop the unit allows actuation using a broom handle or foot, eliminating stooping and bending during device start-up and power-down.

During non-use, the device is parked in a charging nest. The nest recharges an on-board battery pack used to power the vacuum motor. Contacts exposed facially on a ramp within the nest communicate with terminals mounted beneath the vacuum unit to achieve re-charge. A foot lever may be mounted aside the nest to kick the pan free of such nest.

In an alternative embodiment, RF sensors installed in the vacuum unit guide the unit to an RF transmitter strapped to a broom, directing mini-controllers to actuate servos driving the vacuum unit wheel mechanisms. In this embodiment, the wheel mechanisms include transmissions allowing both free rotational movement in addition to direct drive movement.

Other features and advantages of the invention will become apparent from the following detailed description, taken in conjunction with the accompanying drawings, which illustrate by way of example, the features of the invention.

DESCRIPTION OF THE PREFERRED EMBODIMENT

Typical vacuum cleaning devices incorporate designs enabling manipulation of the vacuum devices directly over the areas to be cleaned. Such designs require the user to retrieve the device from storage each time it is to be used for transport to the site of the dirt to be wheeled or otherwise manipulated over such dirt in effort to draw it into the dust collector bag. Fatigue generated by repetitive cleaning motions over large surfaces, combined with constant stooping and bending, often discourages frequent and extended use of many typical vacuum cleaners. The present invention reduces this deficiency by providing a cordless suction assembly capable of collecting dirt, hair, and other debris swept to it, thereby eliminating the necessity of conveying the device itself to the site of the dirt for direct manipulation over the dirt.

Figure 1:
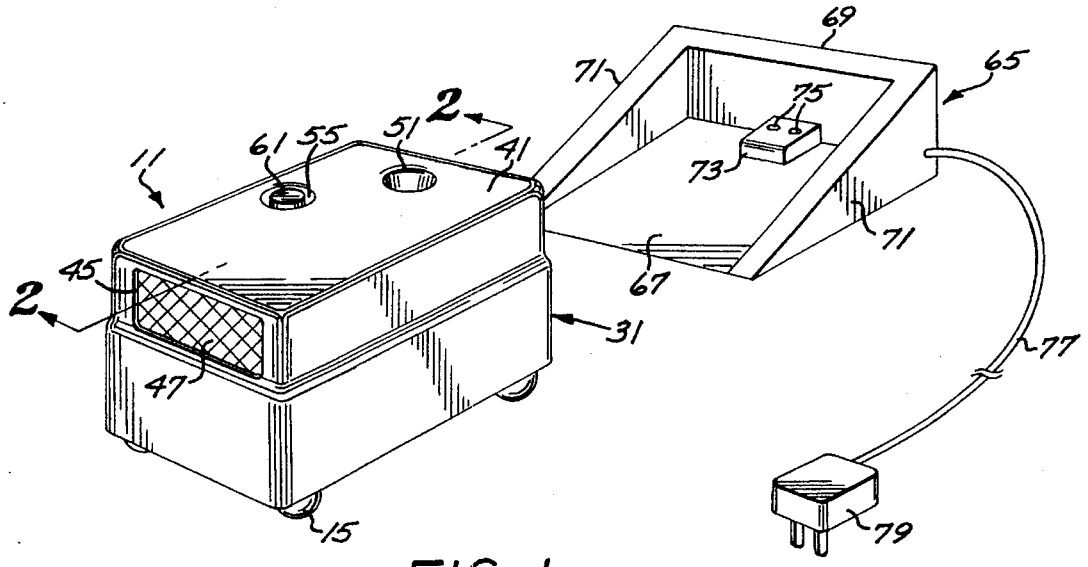
FIG. 1 is a perspective view of a vacuum dustpan together with a charger unit embodying a novel feature of the present invention.
Figure 2:
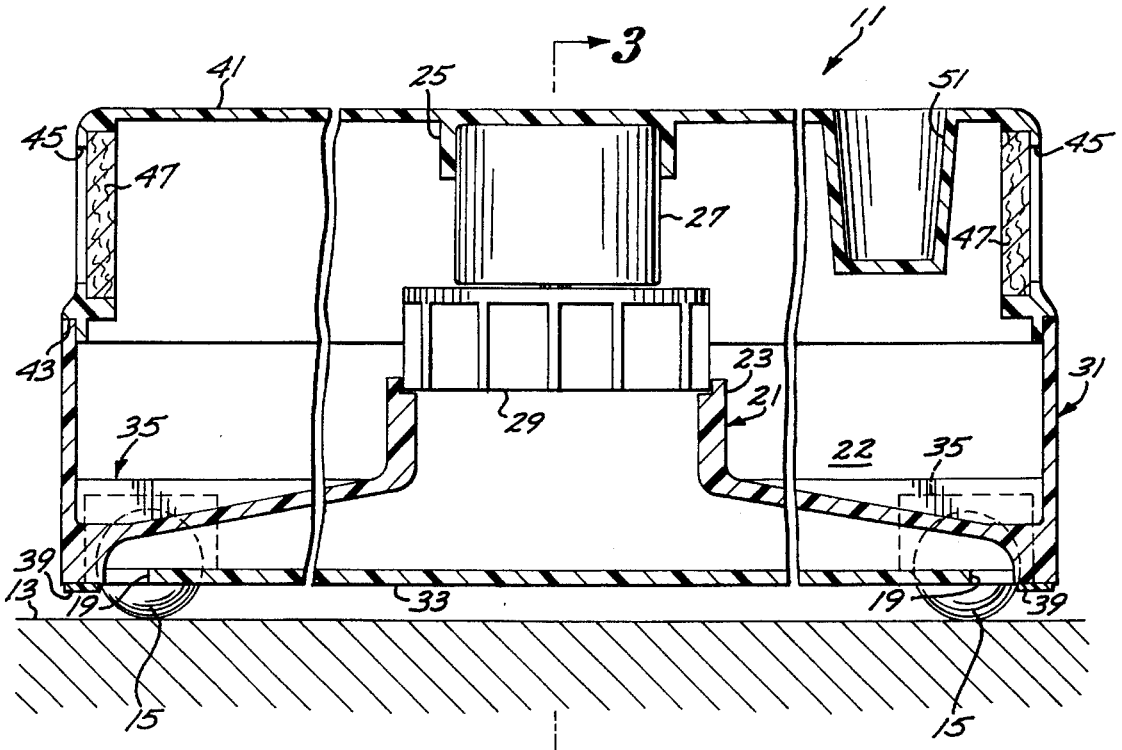
FIG. 2 is an enlarged vertical cross-sectional view taken substantially along line 2—2 of FIG. 1.
Figure 3:
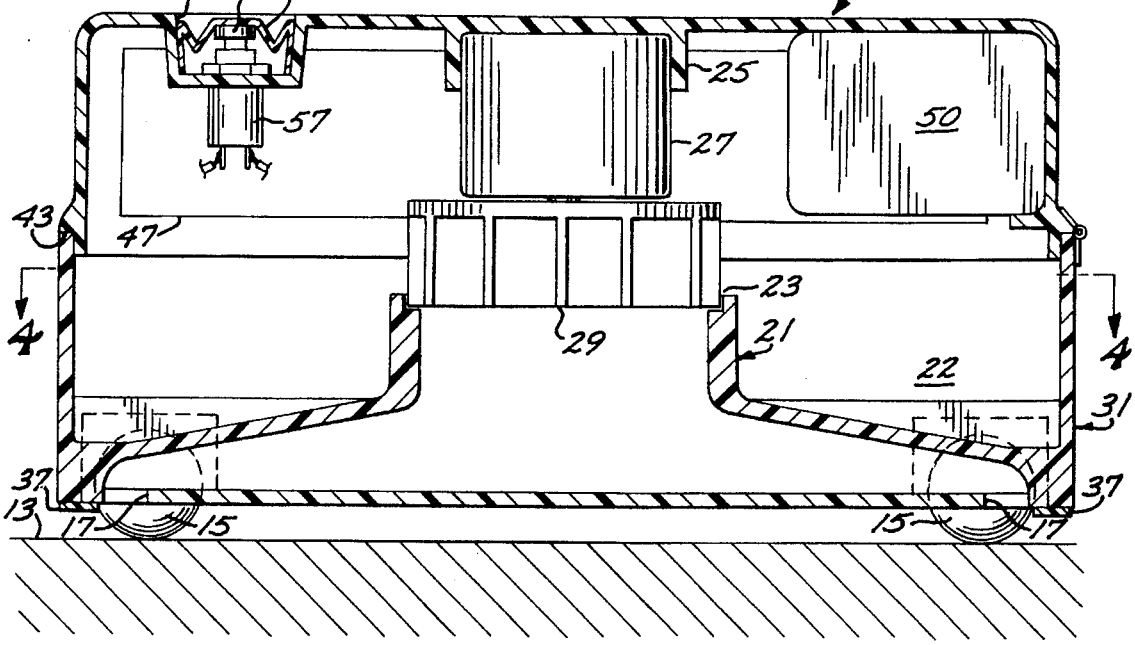
FIG. 3 is an enlarged vertical cross-sectional view taken substantially along line 3—3 of FIG. 2
Figure 4:
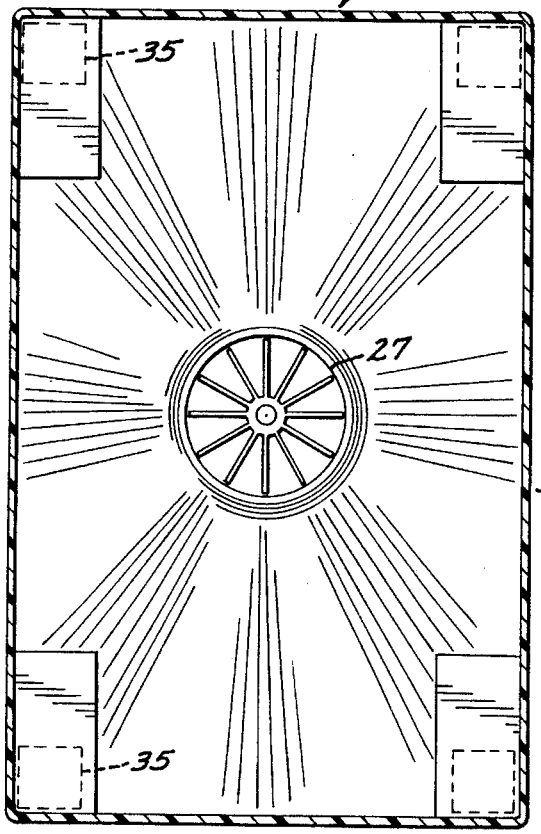
FIG. 4 is a reduced scale, horizontal cross-sectional view taken along line 4—4 of FIG. 3.

Referring to FIGS. 1–3, the vacuum dustpan of the present invention includes, generally, a boxlike rectangular housing 11 carried in a slightly elevated position from an underlying floor 13 by means of ball rollers 15 located at the four corners of the bottom thereof. The housing is formed in its bottom wall with elongated linear longitudinal and transverse nozzles 17 and 19 (FIG. 5) which face downwardly and are elevated from the surface 13. Vacuum ducting, generally designated 21, is formed by walls configured in a funnel shape to radiate inwardly and angle upwardly from the respective peripheral walls of such housing 11 from respective points outboard of the respective nozzles 17 and 19 and to then turn upwardly to form a cylindrical duct outlet 23. Referring to FIG. 2, formed interiorly under the top wall of the housing 11 is a cylindrical motor housing flange 25 which mounts a DC motor 27 having a vacuum impeller 29 mounted on the drive shaft thereof and disposed in confronting relationship with the outlet duct 23. A battery pack 50 (FIG. 3) is provided to be recharged for the purpose of powering the motor 27 to drive the vacuum impeller 29 for operation independent of electrical cords and the like so that the vacuum dustpan itself may be easily maneuvered over the floor surface 13 in a multitude of different directions. The operator can thus maneuver such device around by either nudging it in one direction or the other with his or her foot or, possibly pushing it with a cleaning broom, to a desired location. The broom itself will then be utilized to clean the surface of the floor 13 by sweeping dirt, debris, dust, animal hair and the like toward the vacuum dustpan so that such debris will be drawn inwardly underneath the housing 11 and upwardly into the linear nozzles 17 and 19 to be deposited in the annulus 22 about the top side of the duct 21 which will act as a dust bowl for deposit of the such dirt and debris.

Figure 5:
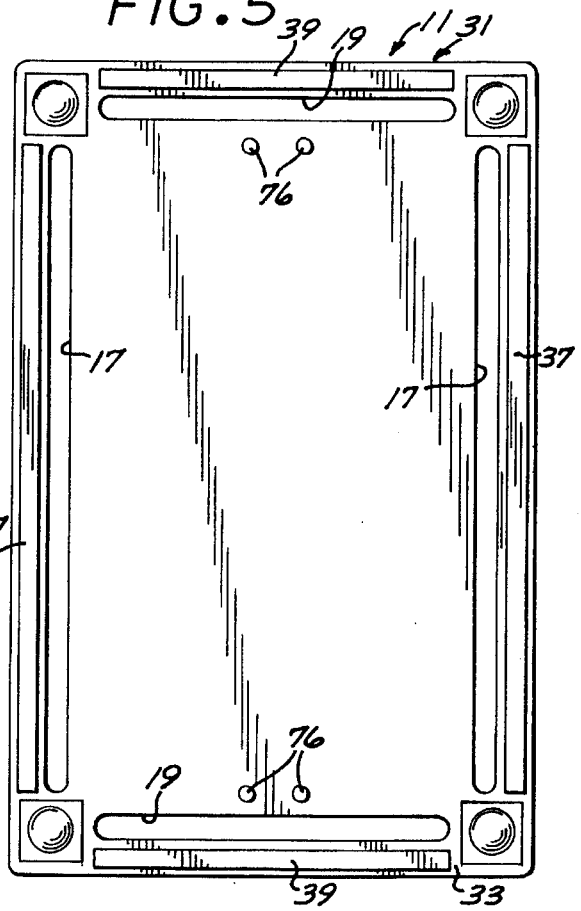
FIG. 5 is a reduced scale bottom plan view.

Referring to the drawings in more detail, the housing 11 may be constructed of molded plastic or the like and is configured with a rectangular base, preferably fourteen inches long by twelve inches wide, and generally designated 31, which surrounds the ducting 21 and, in practice, is constructed of a resilient plastic to absorb impact and minimize any damage or marring which might result from contact with the peripheral walls or furniture in the area being cleaned. Optionally, a resilient bumper may be affixed to the outer periphery of the housing to provide even more protection. The base 31 is formed with a bottom wall 33 about the periphery of which the nozzles 17 and 19 are formed. Preferably, the nozzles are unobstructed and approximately ¼ inch wide and ten inches long. Incorporated at the four corners of the base 31 are respective roller housings 35 which are formed with spherical downwardly opening roller sockets for receipt of the respective rollers 15 to be held in place by conventional retainer rings. The rollers 15 are nested upwardly in such housings sufficiently far to support the bottom wall 33 spaced one-half inch off the floor surface 13. Conveniently, magnetic venturi strips 37 and 39, about 1/16 of an inch thick, are mounted to the bottom of the bottom wall 33 outboard of the respective slots 17 and 19 (FIG. 5) to provide a somewhat throttling effect on air being drawn beneath the underside of such base 31 to accelerate such air flow and enhance the suctioning of the dirt into the respective nozzles 17 and 19. The strips 37 and 39 also attract and hold metallic debris, thus preventing such debris from entering the nozzles 17 and 19. Referring to FIG. 5, mounted on the underside of the bottom wall disposed centrally at the opposite ends thereof are respective pairs of electrical contacts 76 connected in circuit with the battery pack 50.

With continued reference to FIGS. 2 and 3, the housing 11 includes a rectangular shaped cap 41 sitting on the base 31 and configured with a top wall and downwardly projecting side and end walls which are formed at their lower extremities with respective outwardly and downwardly opening notches 43 for nesting receipt on the top edges of the upstanding side and end walls of the base 31. The opposite end walls of the cap 41 are formed with respective vent windows 45 which are lined on the interior with respective air filters 47 for venting of air drawn inwardly through the respective nozzles 17 and 19 as forced upwardly and outwardly by means of the vacuum impeller 29. The cap 41 is hinged 44 to the base 31 thus allowing easy access to the interior of the apparatus for debris disposal and maintenance.

Referring to FIGS. 1–3, formed in the top wall of the cap 41, toward one end thereof, is an upwardly opening frusto conically shaped broom handle receiving socket 51. Formed to one lateral side of such cap 41 is an upwardly opening frusto conically shaped switch-receiving well 55 (FIGS. 1 and 3) which mounts to the bottom wall thereof a push button control switch 57 connected in circuit with the motor 27 and including a push button 59 normally biased to its upward position shown in FIG. 3. The well 55 has telescoped therein a cover diaphragm 61 which covers the top of the switch 59 to allow for free depression thereof as, for instance, by the end of a broom handle for convenient control of the motor 27.

Referring to FIG. 1, a recharger pad frame, generally designated 65, is provided for rolling receipt thereinto of the dustpan housing 11. The frame 65 is formed with a downwardly and forwardly inclined bottom wall 67 and is configured with a back wall 69 and downwardly and forwardly tapered side walls 71. Mounted centrally toward the back of the bottom wall 67 is a contact block 73 which mounts on the top thereof a pair of nest contacts 75 arranged and configured to be elevated for alignment with either pair of terminals 76 (FIG. 5) mounted on the underside of the housing 11 for electrical contact therewith when the housing is rolled into the nest formed between the side walls 71. The elevated slope design functions to aid the device when rolling off the charger when used. Fused to the underside of the charger to prevent slippage is a layer of rubber padding (not shown).

An electrical cord 77 is connected on one end with the pad 65 and includes on the free end thereof a converter incorporated in a wall plug 79 for plugging into a conventional 110 volt a/c circuit.

In operation, it will be appreciated that the recharger frame 65 will be typically stored at one corner of the room or possibly in a broom closet or pantry area and will remain plugged into the wall socket with the vacuum dustpan nested thereinto with one pair of the electrical contacts 76 (FIG. 5) engaged with the recharger contacts 75 (FIG. 1 ). When it is desirable to clean the room surface by the dustpan of the present invention, the operator may conveniently open the closet door or the like and merely insert a broom handle into the handle socket 51 to draw the dustpan from the frame 65 and wheel it into the desired position within the room to be swept. It will be appreciated that, since there is no requirement for the motor 27 to drive a rotary vacuum sweeper brush or to self generate sufficient vacuum to act as a cleaning device itself, such motor and the vacuum impeller 29 may be of a relatively lightweight inexpensive construction and thus may be maneuvered around with relative ease to essentially be floated over the multi-directional support rollers 15 to the location desired. It will also be appreciated that due to the mobile nature of this device, a substantially larger and more powerful motor could be installed thereby giving the device greater suction capability and allowing the base to be raised without detracting from its ease of use or effectiveness. The operator may then depress the switch button 59 with, for instance, the top end of an inverted broom handle to energize the motor 27 and actuate the vacuum impeller 29 to draw ambient air from the proximate area underneath the four sides of the base 31 to be accelerated past the respective venturi strips 37 and 39 and into the respective nozzles 17 and 19 to be drawn upwardly within the ducting 21 past the impeller 29 to then be blown outwardly through the respective air filters 47 and out the respective vent windows 45. Any dust, debris, hair, or the like in the air so circulated through the dust pan will be filtered out and deposited in the annular dust bowl 22 formed about the top side of the ducting 21.

It will be appreciated that the bristles of the broom sweeping the floor surface 13 will typically accelerate the dirt, debris, hair and the like into the general vicinity of the periphery of the base 31 to thus be influenced by the air drawn underneath such base at an accelerated rate such as to cause the air current to add to the velocity vector imparted to such particles by means of the broom thereby enhancing movement of such particles and directly subjecting such particles to the venturi effect produced underneath the respective venturi strips 37 and 39, thereby causing the air current drawn in through the respective nozzles 37 and 39 to carry such dirt therewith to be deposited in the dust bowl 22. With the bottom wall 33 elevated about one-half inch above the floor surface 13, it would be appreciated that debris and obstacles of substantial size, such as popcorn and the like, can be drawn under the venturi strips 37 and 39 and into the nozzles 17 and 19 to be drawn upwardly past the impeller 29 and deposited into the dust bowl 22. Moreover, the open, unrestricted character of the nozzles 17 and 19 will provide only minimum resistance to air flow and will allow for relative unrestricted movement of debris therethrough thus minimizing any tendency to clog or restrict travel of the debris, hair and the like. The cordless feature for the subject dustpan allows for great freedom of movement without the necessity of dragging an electrical cord along or of the undesirable wrapping of a cord about the housing itself or restricting movement thereof.

Figure 7:
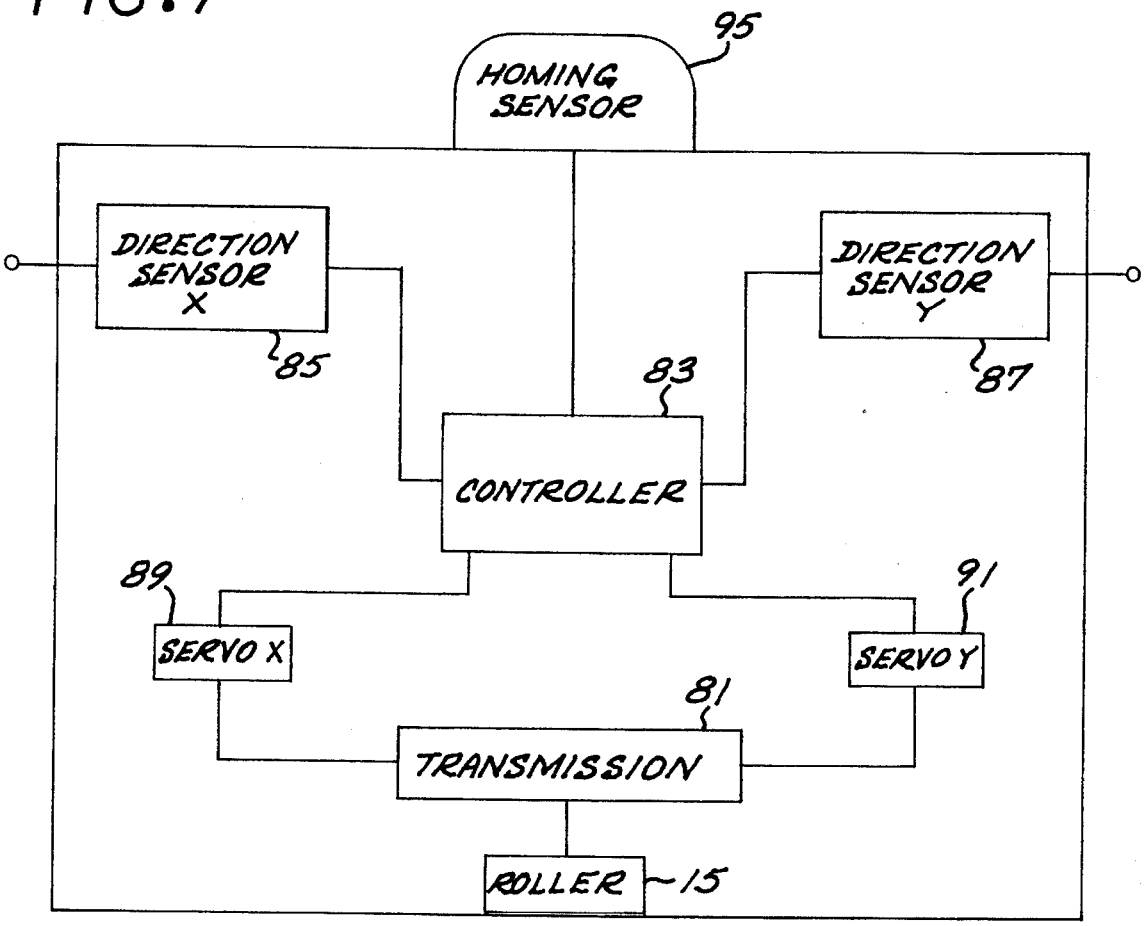
FIG. 7 is a functional schematic view of the electronic circuit incorporated in the vacuum dustpan shown in FIG. 1.

Referring to FIG. 7, there is shown an electrical circuit which may be incorporated in a second embodiment of the vacuum dustpan of the present invention. The vacuum dustpan of FIG. 7 includes a transmission 81 coupled with one or more of the rollers 15 and connected in circuit with an inner connected controller 83 having its input connected with respective X and Y RF directional sensors 85 and 87 and its output connected with the transmission 81 by means of respective X and Y servo motors 89 and 91. Additionally, an RF homing sensor 95 is connected with the controller 83.

Figure 6:
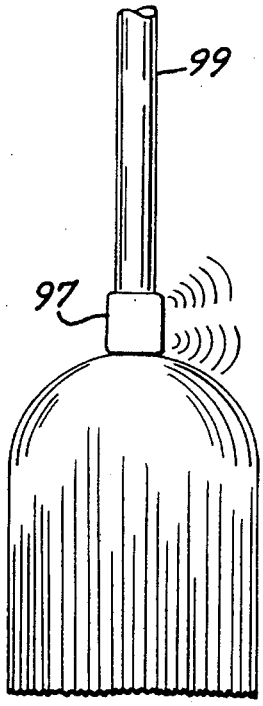
FIG. 6 is a partial view of a broom embodying a novel feature of the invention.

Referring to FIG. 6, an RF transmitter 97 is removably coupled to a broom handle 99 and is actuable to transmit selected radio signals to the homing sensor 95 to cooperate with the fractional sensors 85 and 87 to control one or more pairs of the rollers 15 for automatic manipulation of the vacuum dustpan for maneuvering to the general proximity of the broom transmitter 97.

The dustpan of the construction shown in FIGS. 6 and 7 then allows for the RF transmitter 97 on the broom handle 99 to be energized to transmit a radio signal to the homing sensor 95 so that the controller 83 will be operated as influenced by the directional sensors 85 and 87 to actuate the servo motors 89 and 91 to act through the transmission 81 and drive the rollers 15 to cause such rollers to maneuver the vacuum dustpan into the general proximity of the broom 97. The transmitter 97 may then be deactuated and the broom manipulated to sweep the dirt into the proximity of the air currents being drawn into the vacuum dustpan to thereby retrieve and deposit such dirt as described hereinabove.

From the foregoing, it will be appreciated that the vacuum dustpan of the present invention provides an economical and convenient means for enhancing the utility and convenience of cleaning a floor with a broom. The broom need only move the dirt in the general direction of the dustpan from where it will be drawn under the influence of vacuum and air currents into the dust bowl for collection or subsequent unloading thereof. The device is convenient to manipulate about and eliminates the physical exertion of requiring the floor cleaning personnel to stoop and bend and manipulate a broom and dustpan in coordination and endeavor to pack and contain relatively light dirt components, such as human and animal hair and dust balls, which might otherwise be shifted under the influence of air current from the confines of a conventional dustpan.

What is claimed is:

1. Vacuum dustpan apparatus for collecting dirt from a supporting floor surface and comprising:

a housing formed with downwardly projected peripheral walls terminating in respective bottom edges to define a bottom side, said housing including downwardly opening marginal nozzles co-extensive with said edges and extending around the periphery of said bottom side, said housing including a motor mount;

ducting formed with a vacuum impeller inlet and leading from said nozzles toward said motor mount;

a dust collection bowl;

a vacuum impeller interposed between said inlet and said bowl;

a motor mounted on said motor mount and connected with said impeller;

a rechargeable battery pack mounted on said housing and connected with said motor;

a charger for connection with said battery; and multidirectional rollers mounted under said housing for supporting said nozzles in close spaced relation with respect to said floor surface to be cleaned whereby said housing may be rolled in any direction on said floor supported on said rollers to different selected locations and said motor energized to draw a partial vacuum in said nozzles so that dirt may be swept across said floor from any direction to be disposed proximate one of said nozzles to be drawn thereto.

2. Vacuum dustpan apparatus according to claim 1 that includes:

charger contacts mounted on said housing and connected with said battery; and said charger including a nest configured to complementarily receive said housing and including charging terminals disposed for, when said portion of said housing is nested in said nest, contacting said charger contacts on said housing.

3. Vacuum dustpan apparatus according to claim 1 wherein:

said housing is formed rectangularly in plan view and includes a top wall having an underside and having said motor mount formed centrally on said underside thereof and a bottom wall having said nozzles arranged in a substantially square pattern;

said ducting is formed with a wall projecting downwardly from said inlet and flaring laterally outwardly and downwardly to join said bottom wall laterally outwardly of the respective said nozzles; and said impeller is interposed between said motor and said inlet to draw a partial vacuum in said ducting to draw dirt swept toward any of said nozzles into the respective said nozzles to be directed through said ducting to said bowl.

4. Vacuum dustpan apparatus for collecting dirt from a supporting floor surface and comprising:

a housing formed with downwardly projected peripheral walls terminating in respective bottom edges to define a bottom side, said housing including downwardly opening marginal nozzles co-extensive with said edges and extending around the entire periphery of said bottom side, said housing including a motor mount;

ducting formed with a vacuum impeller inlet and leading from the respective nozzle toward said motor mount;

a dust collection bowl;

a vacuum impeller interposed between said inlet and said bowl;

a motor mounted on said motor mount and connected with said impeller;

multidirectional rollers mounted under said housing for supporting said nozzles in close spaced relation with respect to said floor surface to be cleaned whereby said housing may be rolled in any direction on said floor supported on said rollers to different selected locations and said motor energized to draw a partial vacuum in said nozzles so that dirt may be swept across said floor from any direction to be disposed proximate one of said nozzles to be drawn thereto;

at least one servomotor; and a transmission for connecting said servomotor with one of said rollers for driving said roller.

5. Vacuum dustpan apparatus according to claim 4 for use with a broom and including:

a remote RF transmitter mounted to said broom and operative to transmit an RF homing signal;

a controller on said housing for actuating said transmission and including an RF receiver connected in circuit to said controller and responsive to said RF signal to activate said controller.

* * * * *